US009744764B2

(12) United States Patent
Matsuo

(10) Patent No.: US 9,744,764 B2
(45) Date of Patent: Aug. 29, 2017

(54) ELECTRONIC DEVICE, AND MANUFACTURING METHOD OF ELECTRONIC DEVICE

(71) Applicant: SEIKO EPSON CORPORATION, Tokyo (JP)

(72) Inventor: Yoshihide Matsuo, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/065,599

(22) Filed: Mar. 9, 2016

(65) Prior Publication Data

US 2016/0271944 A1 Sep. 22, 2016

(30) Foreign Application Priority Data

Mar. 20, 2015 (JP) ..... 2015-057123

(51) Int. Cl.
*B41J 2/14* (2006.01)
*B41J 2/16* (2006.01)

(52) U.S. Cl.
CPC ..... *B41J 2/14* (2013.01); *B41J 2/14233* (2013.01); *B41J 2/161* (2013.01); *B41J 2/1623* (2013.01); *B41J 2/1631* (2013.01); *B41J 2002/14362* (2013.01); *B41J 2002/14491* (2013.01)

(58) Field of Classification Search
CPC . B41J 2/14; B41J 2/14233; B41J 2/161; B41J 2/1623; B41J 2/1631; B41J 2002/14362; B41J 2002/14491
See application file for complete search history.

(56) References Cited

U.S. PATENT DOCUMENTS

2014/0092177 A1 4/2014 Sugahara et al.

FOREIGN PATENT DOCUMENTS

| | | |
|---|---|---|
| EP | 2 778 743 | 9/2014 |
| JP | 2013 095088 | 5/2013 |
| JP | 2014-051008 | 3/2014 |
| WO | 2011/132516 | 10/2011 |

OTHER PUBLICATIONS

Machine Translation of JP 2013095088A, Miyai, Mitsuyoshi et al., Inkjet Head, Manufacturing Method Thereof, and Inkjet Plotter, Konica Minolta Holdings, May 20, 2013, Paragraphs 0041-0045, 0047-0048, 0051-0052, 0073.*
European Search Report for Application No. 16157279.7 dated Aug. 18, 2016.

* cited by examiner

*Primary Examiner* — Lisa M Solomon
(74) *Attorney, Agent, or Firm* — Workman Nydegger

(57) ABSTRACT

An electronic device includes a first drive substrate (a pressure chamber substrate and a vibration plate) including a piezoelectric element formed thereon, and a second substrate (a sealing plate) bonded to the first drive substrate, a bonding resin forms an accommodating space that surrounds and accommodates a drive region of the piezoelectric element between the first substrate and the second substrate, and a reinforced resin that supports the first substrate and the second substrate in a position deviated from the drive region in the accommodating space.

7 Claims, 8 Drawing Sheets

ELECTRONIC DEVICE, AND MANUFACTURING METHOD OF ELECTRONIC DEVICE

The entire disclosure of Japanese Patent Application No: 2015-057123, filed Mar. 20, 2015 is expressly incorporated by reference herein in its entirety.

BACKGROUND

1. Technical Field

The present invention relates to an electronic device, and a manufacturing method of an electronic device, in which a first substrate including a drive element formed thereon is bonded to a second substrate, in a state of a bonding resin being interposed therebetween.

2. Related Art

An electronic device includes a drive element such as a piezoelectric element that is deformed in response to an applied voltage, and the electronic device is applied to various types of devices, sensors, or the like. For example, a liquid ejecting apparatus ejects various types of liquid from a liquid ejecting head using the electronic device. Examples of the liquid ejecting apparatus include an image recording apparatus such as an ink jet printer and an ink jet plotter, but in recent years, the liquid ejecting apparatus has also been applied to various manufacturing apparatuses, by taking advantage of features that a very small amount of liquid can be accurately landed at a predetermined position. For example, the liquid ejecting apparatus has been applied to a display manufacturing apparatus that manufactures a color filter for a liquid crystal display, or the like, an electrode forming apparatus that forms electrodes in an organic electro luminescence (EL) display, a field emission display (FED), or the like, and a chip manufacturing apparatus that manufactures a bio-chip (a biochemical element). Then, a recording head for the image recording apparatus ejects liquid ink, and a color material ejecting head for the display manufacturing apparatus ejects respective color material solutions of Red (R), Green (G), and Blue (B). Further, an electrode material ejecting head for the electrode forming apparatus ejects liquid electrode materials, and a bio-organic material ejecting head for the chip manufacturing apparatus ejects a bio-organic material solution.

The liquid ejecting head includes an electronic device in which a flow path substrate including a pressure chamber formed thereon in communication with a nozzle, a piezoelectric element (a type of a drive element) causing a pressure fluctuation in liquid inside the pressure chamber, a sealing plate (or also referred to as a protection substrate) provided and spaced from the piezoelectric element, and the like are stacked. In recent years, a technique of providing a drive circuit related to the driving of an actuator such as a piezoelectric element on a sealing plate has also been developed. Then, a technique is proposed in which this substrates are bonded with each other by adhesive (adhesive resin) made of photosensitive resin in a state where there is a space therebetween. In addition, a structure is adopted in which substrates are stacked by a photosensitive resin in order to correspond to the high density and miniaturization of a wiring, in a semiconductor package of a micro electro mechanical systems (MEMS) such as various sensors. For example, in an ink jet printer which is disclosed in JP-A-2014-51008, a plurality of piezoelectric elements as a drive element are formed on a vibration plate of a flow path unit, and the vibration plate is bonded to a substrate (a driver IC) including a drive circuit formed therein, in a state of the piezoelectric element and bump electrodes or the like for driving the piezoelectric element being interposed therebetween. Further, sealing material made of insulating material such as synthetic resin is arranged along the bump electrode, and a space that accommodates a piezoelectric element or the like is hermetically sealed by the sealing material and is blocked from the atmosphere. This sealing material also functions as adhesive (bonding resin) for bonding the substrates to each other.

However, in the configuration in which the substrates are bonded to each other in a state of structures such as the piezoelectric element and the bump electrodes for driving the piezoelectric element being interposed therebetween, an unevenness (relief) caused by these structures is generated on the bonding surface of the substrate. The bonding resin such as the afore-mentioned sealing member is designed to have a height (a thickness during application) aligned to the largest bump electrode, among the structures. However, since there is a relief on the bonding surface of the substrate, there is a need for applying a pressure to some extent when bonding the substrates to each other in order to fill this relief. In this case, since there is a space for accommodating the piezoelectric element and the like between the substrates, there are cases where deformation such as warpage or distortion occurs in the substrate, with the bump electrode and the bonding resin as a reference. If the substrate is deformed, there is a possibility in that the malfunction such as contact failure occurs in the bump electrode.

SUMMARY

An advantage of some aspects of the invention is to provide an electronic device and a manufacturing method of an electronic device, which capable of suppressing deformation such as warpage of the substrate, when boding the substrates with each other.

Aspect 1

According to an aspect of the invention, an electronic device includes a first substrate and a second substrate which are bonded through a bonding resin having photosensitivity, the first substrate including a drive element, that deforms a drive region, provided in the drive region for which flexural deformation is acceptable, and the second substrate being provided and spaced from the first substrate by interposing the drive element and a structure related to driving of the drive element therebetween, in which the bonding resin forms an accommodating space that surrounds and accommodates the drive region, between the first substrate and the second substrate, and a supporting portion, that supports the first substrate and the second substrate, is formed at a position deviated from the drive region, in the accommodating space.

According to a configuration of Aspect 1, since the supporting portion supports both substrates even in the configuration in which the accommodating space is formed between the first substrate and the second substrate, even if pressure is applied in the stack direction at the time of bonding the first substrate and second substrate, the deformation of the substrate such as warpage or distortion is suppressed. Thus, it is possible to suppress malfunction caused by the deformation of a substrate, for example, connection failure of the electrode related to driving of the drive element.

Aspect 2

Further, in the configuration of Aspect 1, it is preferable to adopt a configuration in which the supporting portion related to each of adjacent drive regions is arranged in a corresponding position, in the accommodating space thereof.

According to a configuration of Aspect 2, it is possible to arrange the supporting portion without any trouble in the driving of the drive element.

Aspect 3

Further, in the configuration of Aspect 1 or Aspect 2, it is preferable to adopt a configuration in which the supporting portion is formed by a resin of the same type as the bonding resin.

According to a configuration of Aspect 3, since it is possible to form the supporting portion in the same process as in the bonding resin, an increase in the number of processes is prevented.

Aspect 4

Further, in the configuration of any one of Aspect 1 to Aspect 3, it is preferable to adopt a configuration in which a bump electrodes related to driving of the drive element is formed on any one substrate of the first substrate and the second substrate so as to protrude in the other substrate, the bump electrodes are respectively arranged on both sides in a direction perpendicular to an arrangement direction of the drive region, across a region in which the drive region is formed, and the accommodating space is formed between the bump electrodes on both sides.

According to a configuration of Aspect 4, since deformation of the substrate such as warpage, twisting or distortion of the substrate is suppressed by the supporting portion, with the bump electrode as a reference.

Aspect 5

According to another aspect of the invention, a manufacturing method of an electronic device including a first substrate and a second substrate which are bonded through a bonding resin having photosensitivity, the first substrate including a drive element, that deforms a drive region, provided in the drive region for which flexural deformation is acceptable, and the second substrate being provided and spaced from the first substrate by interposing the drive element and a structure related to driving of the drive element therebetween, includes applying a resin having photosensitivity to the first substrate; forming a bonding resin that forms an accommodating space which accommodates the drive region, by patterning the applied resin and surrounding a region in which the drive region is formed, and a supporting portion that supports the first substrate and the second substrate at a position deviated from the drive region, in the accommodating space; and bonding the first substrate and the second substrate, in a state of interposing the bonding resin and the supporting portion between the first substrate and the second substrate.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the present invention will be described with reference to the accompanying drawings. Note that in the embodiments described below, various limits are presented as preferred specific embodiments of the invention, but the scope of the present invention is not limited to these embodiments, unless a particular description for limiting the invention is given in the following description. Further, in the following description, an ink jet printer (hereinafter, referred to as a printer) which is a type of a liquid ejecting apparatus equipped with an ink jet recording head (hereinafter, referred to as a recording head) which is a type of a liquid ejecting head provided with an electronic device according to the present invention will be described as an example.

Figure 1:
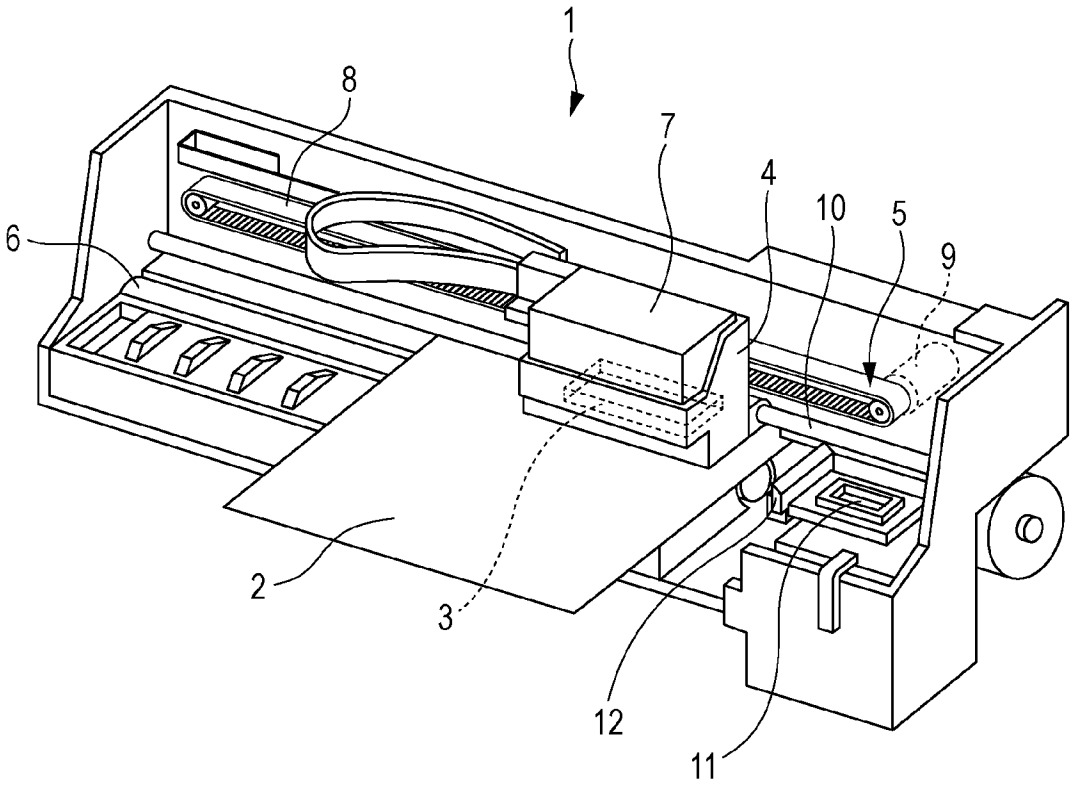
FIG. 1 is a perspective view illustrating a configuration of a printer.

The configuration of the printer 1 will be described with reference to FIG. 1. The printer 1 is an apparatus that records an image or the like by ejecting and discharging ink (a type of liquid) onto the surface of the recording medium 2 such as a recording sheet. The printer 1 includes a recording head 3, a carriage 4 including the recording head 3 attached thereto, a carriage moving mechanism 5 that moves the carriage 4 in a main scanning direction, a transport mechanism 6 that transports the recording medium 2 in a sub-scanning direction, and the like. Here, the ink is retained in the ink cartridge 7 which is a liquid supply source. The ink cartridge 7 is detachably mounted on the recording head 3. In addition, a configuration can be employed in which an ink cartridge is disposed on the body side of a printer, and ink is supplied from the ink cartridge to a recording head through an ink supply tube.

The carriage moving mechanism 5 includes a timing belt 8. The timing belt 8 is driven by a pulse motor 9 such as a DC motor. Therefore, when the pulse motor 9 is operated, the carriage 4 is guided to a guide rod 10 that is installed in the printer 1, and reciprocates in the main scanning direction (in the width direction of the recording medium 2). The position of the carriage 4 in the main scanning direction is detected by a linear encoder (not illustrated). The linear encoder transmits the detection signal, that is, an encoder pulse to the control unit of the printer 1.

A home position that becomes a base point of the scanning of the carriage 4 is set further in the outer end region than the recording region within the moving range of the carriage 4. A cap 11 that seals a nozzle 22 that is formed on the nozzle surface (a nozzle plate 21) of the recording head 3, and a wiping unit 12 that wipes the nozzle surface are arranged in order from the end side in the home position.

Figure 2:
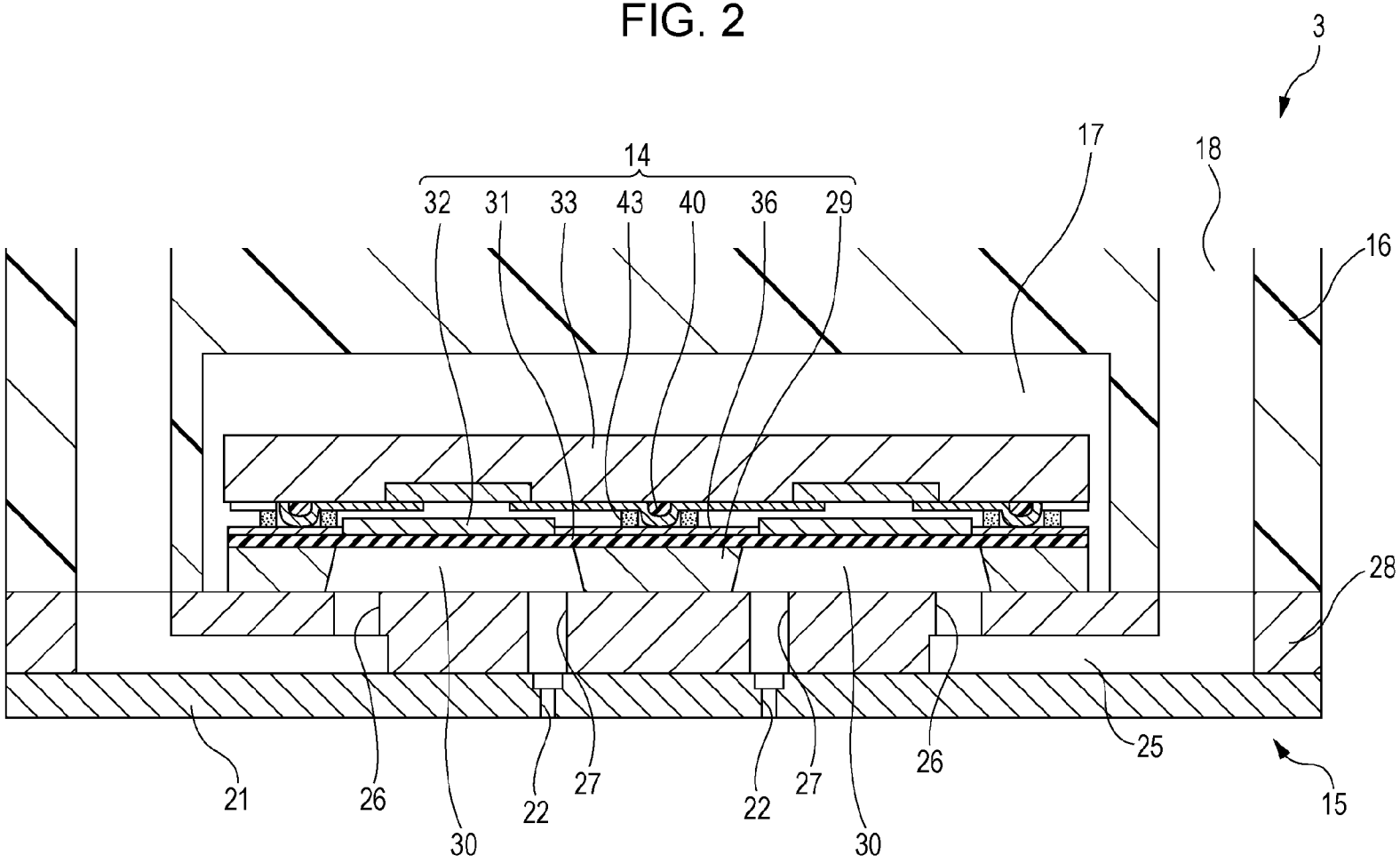
FIG. 2 is a cross-sectional view illustrating a configuration of a recording head.
Figure 3:
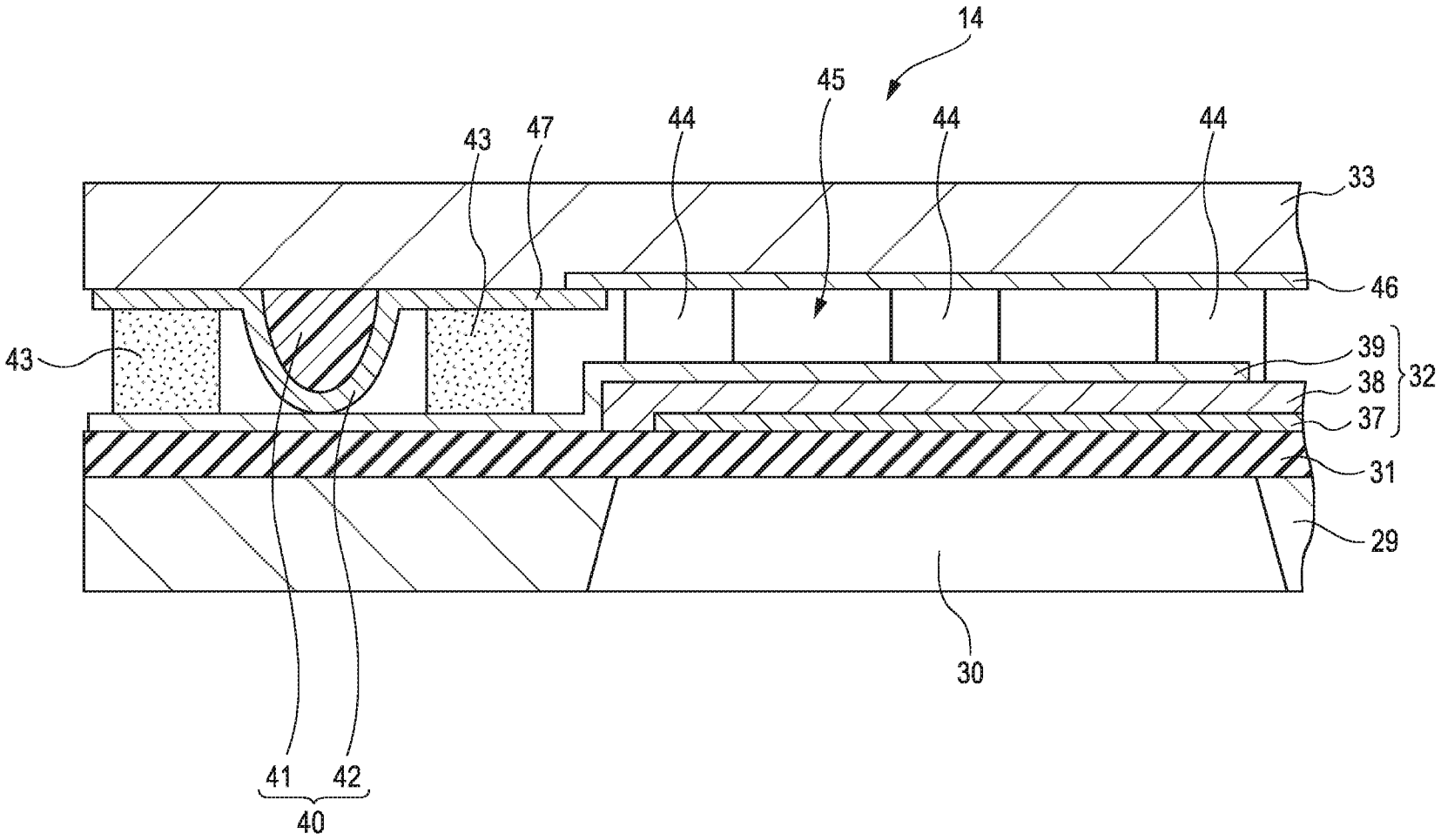
FIG. 3 is an enlarged cross-sectional view of a main portion of an electronic device.
Figure 4:
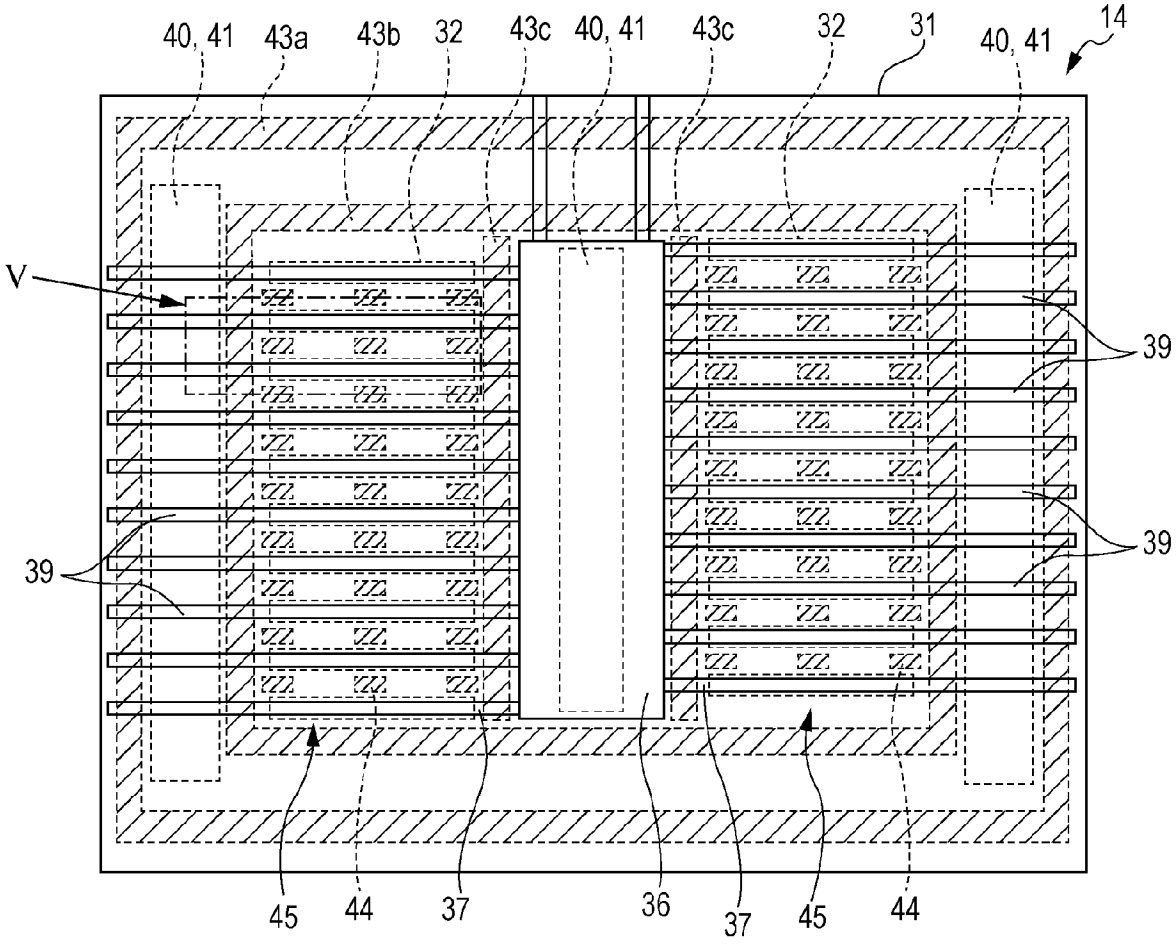
FIG. 4 is a plan view illustrating the configuration of an electronic device.
Figure 5:
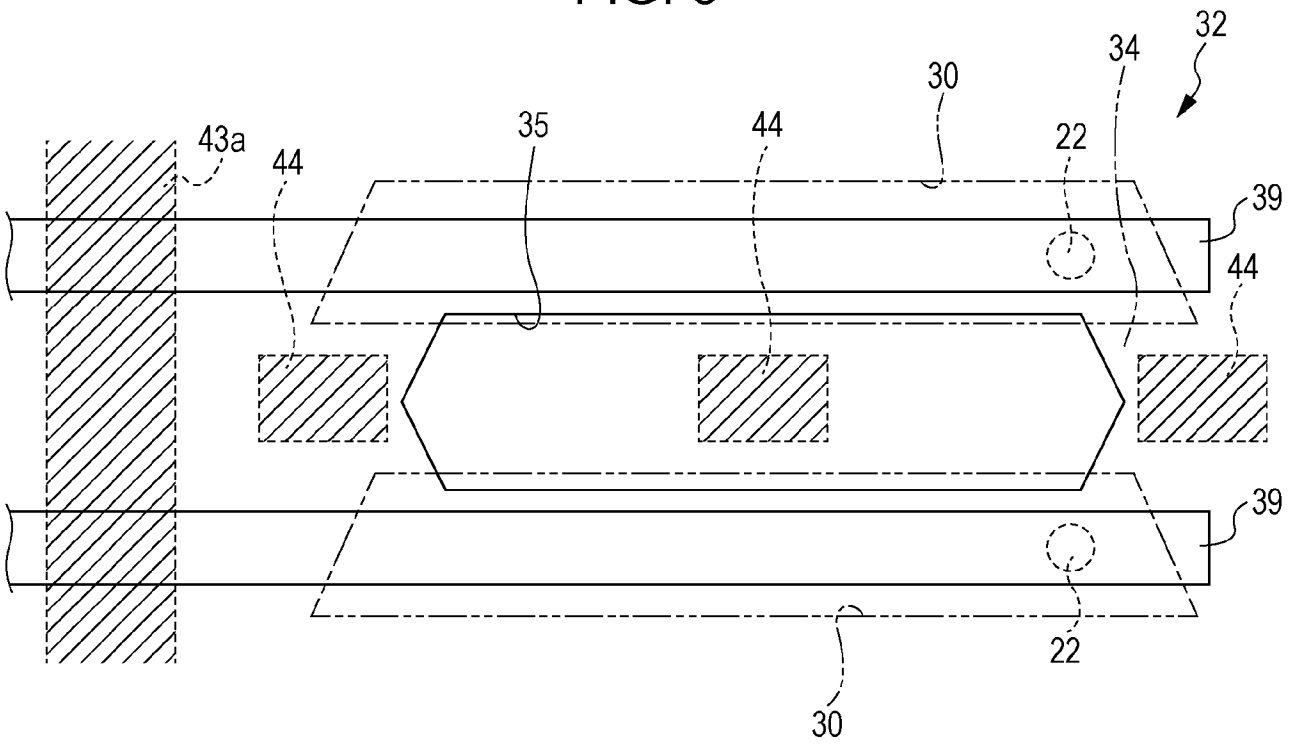
FIG. 5 is an enlarged view of a region V in FIG. 4.
Figure 6A:
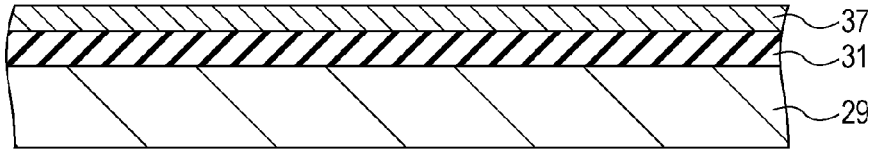
FIG. 6A is a schematic diagram illustrating a manufacturing process of the electronic device.
Figure 6B:
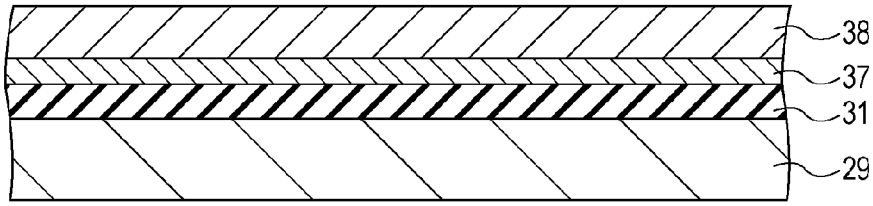
FIG. 6B is a schematic diagram illustrating a manufacturing process of the electronic device.
Figure 6C:
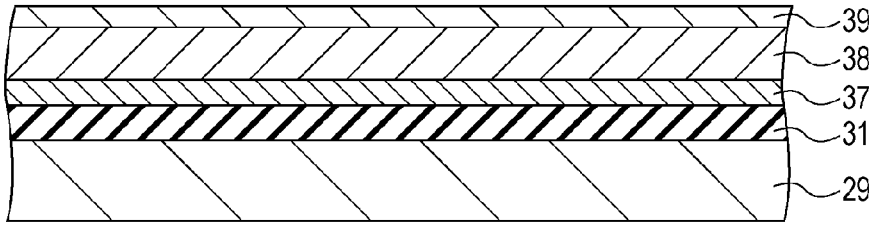
FIG. 6C is a schematic diagram illustrating a manufacturing process of the electronic device.
Figure 6D:
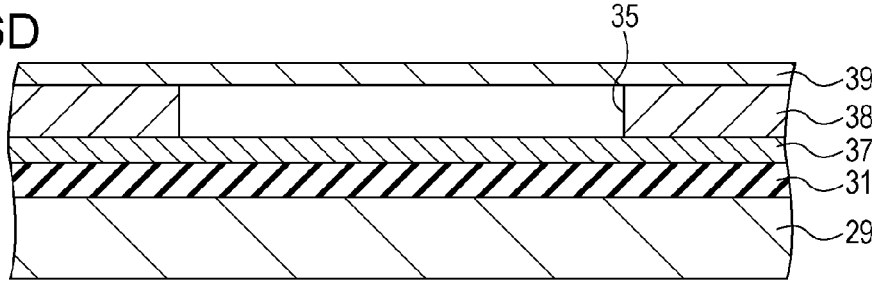
FIG. 6D is a schematic diagram illustrating a manufacturing process of the electronic device.
Figure 6E:
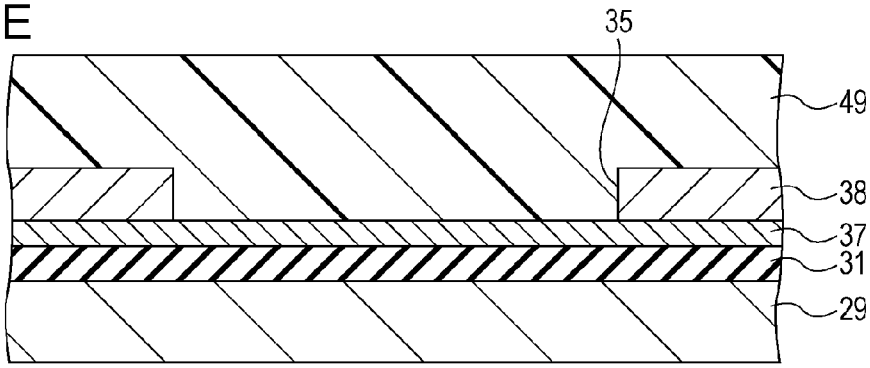
FIG. 6E is a schematic diagram illustrating a manufacturing process of the electronic device.

Next, the recording head 3 will be described. FIG. 2 is a cross-sectional view illustrating the configuration of the recording head 3. FIG. 3 is an enlarged cross-sectional view of a main portion of an electronic device 14. FIG. 4 is a plan view illustrating the configuration of the electronic device 14, and focuses on the configuration of the upper surface (a surface bonded with the sealing plate 33) of the vibration plate 31. FIG. 5 is an enlarged plan view of a region V in FIG. 4. As illustrated in FIG. 2, the recording head 3 in the present embodiment is attached to the head case 16 in a state where the electronic device 14 and the flow path unit 15 are stacked. It should be noted that, for the sake of convenience, the stacking direction of respective members will be described as a vertical direction.

The head case 16 is a box-shaped member made of synthetic resin, and includes a first reservoir 18 that supplies ink to each pressure chamber 30 formed therein. The first reservoir 18 is a space that stores ink common to a plurality of the pressure chambers 30 which are arranged in parallel, and is formed along the nozzle array direction. An ink introduction path (not illustrated) for introducing the ink from the ink cartridge 7 side to the first reservoir 18 is formed above the head case 16. An accommodating hollow portion 17, that is recessed in a rectangular parallelepiped shape from the lower surface to the middle, in the height direction of the head case 16, is formed on the lower surface side of the head case 16. It is configured that if a flow path unit 15 to be described later is bonded with the lower surface of the head case 16 in positioned state, the electronic device 14 (a pressure chamber substrate 29, a vibration plate 31, a sealing plate 33, and the like) that is stacked on the flow path substrate 28 is accommodated in the accommodating hollow portion 17.

The flow path unit 15 which is bonded to the lower surface of the head case 16 includes a flow path substrate 28 and a nozzle plate 21. The flow path substrate 28 in the present embodiment is made of a silicon single crystal substrate. As illustrated in FIG. 2, a second reservoir 25 which is in communication with the first reservoir 18 and stores ink common to the respective pressure chambers 30, and a separate communication path 26 that individually supplies ink from the first reservoir 18 to the respective pressure chambers 30 through the second reservoir 25 are formed by etching on the flow path substrate 28. The second reservoir 25 is an elongated hollow portion along the nozzle array direction (the arrangement direction of the pressure chamber 30). A plurality of separate communication paths 26 are formed along the arrangement direction of the pressure chamber 30, corresponding to each pressure chamber 30. The separate communication path 26 is in communication with one end in the longitudinal direction of the corresponding pressure chamber 30, in a state where the flow path substrate 28 and the pressure chamber substrate 29 are bonded.

Further, a nozzle communication path 27 passing through the flow path substrate 28 in the thickness direction is formed in a position on the flow path substrate 28 corresponding to each nozzle 22. In other words, a plurality of nozzle communication paths 27 are formed along the nozzle array direction, corresponding to the nozzle arrays. The pressure chamber 30 and the nozzle 22 are in communication with each other through the nozzle communication path 27. The nozzle communication path 27 of the present embodiment is in communication with the end on the other side (on the opposite side of the separate communication path 26) in the longitudinal direction of the corresponding pressure chamber 30.

The nozzle plate 21 is a substrate made of silicon or metal such as stainless steel that is bonded to the lower surface (the surface on the opposite side of the electronic device 14) of the flow path substrate 28. A plurality of nozzles 22 are provided in a row on the nozzle plate 21. A plurality of nozzles 22 (nozzle arrays) which are arranged in a row are provided along the sub-scanning direction perpendicular to the main scanning direction, at a pitch corresponding to the dot formation density, from the nozzle 22 on one side to the nozzle 22 on the other side. In the present embodiment, two sets of nozzle arrays are arranged in parallel on the nozzle plate 21.

The electronic device 14 of the present embodiment is a device formed by stacking thin plate-like components of which each functions as an actuator generating a pressure variation in the ink in each pressure chamber 30. As illustrated in FIGS. 2 and 3, the electronic device 14 is formed into a unit in which a pressure chamber substrate 29, a vibration plate 31, a piezoelectric element 32, and a sealing plate 33 are stacked. In addition, the electronic device 14 is formed smaller than the accommodating hollow portion 17 so as to be accommodated in the accommodating hollow portion 17.

The pressure chamber substrate 29 of the present embodiment is made of a silicon single crystal substrate. A portion of the pressure chamber substrate 29 is completely removed in the thickness direction by etching so as to form spaces to become the pressure chambers 30. A plurality of the spaces, that is, the pressure chambers 30 are arranged in parallel corresponding to the respective nozzles 22. Each pressure chambers 30 is an elongated hollow portion in a direction perpendicular to the nozzle array direction, and is in communication with the separate communication path 26 in one end in the longitudinal direction, and is in communication with the nozzle communication path 27 in the other end.

The vibration plate 31 is a thin film-like member having elasticity, and is stacked on the upper surface (the surface on the opposite side of the flow path substrate 28 side) of the pressure chamber substrate 29. The upper opening of a space which becomes the pressure chamber 30 is sealed by the vibration plate 31. In other words, the pressure chamber 30 is partitioned by the vibration plate 31. The portion corresponding to the pressure chamber 30 (specifically, the upper opening of the pressure chamber 30) in the vibration plate 31 functions as a displacement portion which is displaced in the direction away from the nozzle 22 or in the direction close thereto in accordance with the flexural deformation of the piezoelectric element 32. In other words, the region corresponding to the upper opening of the pressure chamber 30 in the vibration plate 31 becomes a drive region for which flexural deformation is allowed. Meanwhile, the region deviated from the upper opening of the pressure chamber 30 in the vibration plate 31 becomes a non-drive region for which flexural deformation is restricted.

The vibration plate 31 is configured with, for example, an elastic film made of silicon dioxide ($SiO_2$) formed on the upper surface of the pressure chamber substrate 29, and an insulating film made of zirconium oxide ($ZrO_2$) formed on the elastic film. Then, the piezoelectric elements 32 are respectively stacked on regions corresponding to the respective pressure chambers 30 on the insulating film (the surface on the opposite side of the pressure chamber substrate 29 side of the vibration plate 31), that is, drive regions. In addition, the pressure chamber substrate 29 and the vibration plate 31 stacked thereon correspond to the first substrate of the present invention. Further, the surface of the vibration plate 31 on which the piezoelectric element 32 is formed is a bonding surface to which the sealing plate 33 is bonded.

The piezoelectric element 32 of the present embodiment is a so-called flexural mode piezoelectric element. As illustrated in FIG. 3, the piezoelectric element 32 is formed, for example, by sequentially stacking a lower electrode layer 37, a piezoelectric layer 38, and an upper electrode layer 39 on a vibration plate 31. In the present embodiment, the upper electrode layer 39 functions as an individual electrode for each piezoelectric element 32, and the lower electrode layer 37 functions as an electrode common to the respective piezoelectric elements 32. It is also possible to employ a reverse configuration depending on the states of the drive circuit and the wiring. If an electric field corresponding to a potential difference between both electrodes is applied to between the layer 37 and the upper electrode layer 39, the piezoelectric element 32 configured in this manner is subjected to flexural deformation in a direction away from the nozzle 22 or in a direction close thereto. A plurality of piezoelectric elements 32 are arranged in parallel in the nozzle array direction, corresponding to the respective nozzles 22, and as illustrated in FIG. 4, two piezoelectric element groups corresponding to two sets of nozzle arrays are formed respectively on the vibration plate 31 while having a common electrode film 36 to described later interposed therebetween.

Various types of metal such as iridium (Ir), platinum (Pt), titanium (Ti), tungsten (W), tantalum (Ta), and molybdenum (Mo), alloys thereof and the like are used as the upper electrode layer 39 and the lower electrode layer 37. Ferroelectric piezoelectric material such as lead zirconate titanate (PZT), or a relaxor ferroelectric containing metal such as niobium, nickel, magnesium, bismuth or yttrium added thereto is used as the piezoelectric layer 38. In addition, it is possible also to use non-lead material such as barium titanate.

A piezoelectric layer 38 of the present embodiment is formed on the vibration plate 31 so as to cover the entire surface of the lower electrode layer 37. As illustrated in FIG. 5, an opening 35 is formed in a portion corresponding to a region that is interposed between the adjacent pressure chambers 30 in the piezoelectric layer 38, in other words, a portion corresponding to a partition wall 34 that partitions the adjacent pressure chambers 30. The opening 35 is configured with a recess portion or a through hole that is formed by removing a portion of the piezoelectric layer 38, and extends along the opening edge of the pressure chamber 30. In short, this opening 35 is a portion that is relatively thinned than the thickness of the other part of the piezoelectric layer 38, or a portion passing through the piezoelectric layer 38. The drive region of the piezoelectric element 32 is defined with a portion at which the upper electrode layer 39, the piezoelectric layer 38, and the lower electrode layer 37 are overlapped with each other, but in a configuration in which the opening 35 is provided in this manner, a piezoelectric layer 38 of a beam shape provided in a region corresponding to the pressure chamber 30, which is a portion between the adjacent openings 35, and the upper and lower electrodes 37 and 39 interposing the piezoelectric layer 38 function substantially as a drive region.

As illustrated in FIGS. 3 and 5, the end on the other side (the left side in FIGS. 3 and 5, or the opposite side of the common electrode film 36 side in FIG. 4) of the upper electrode layer 39 extends to the vibration plate 31 corresponding to the non-drive region, across the upper opening edge of the pressure chamber 30. Further, as illustrated in FIG. 4, similarly, the end on one side (the common electrode film 36 side in FIG. 4) of the lower electrode layer 37 extends from the drive region to the vibration plate 31 corresponding to a non-drive region on the opposite side of the non-drive region on which the upper electrode layer 39 is stacked, across the upper opening edge of the pressure chamber 30. The common electrode film 36 that functions as a terminal of the common electrode is formed in the center portion which is a region interposed in a piezoelectric element group of the vibration plate 31, and the lower electrode layer 37 is electrically connected to the common electrode film 36.

The sealing plate 33 (corresponding to the second substrate in the present invention) is a silicon-made plate member formed into a flat plate shape. As illustrated in FIG. 3, a drive circuit 46 related to the driving of each piezoelectric element 32 is formed in a region facing the piezoelectric element 32 of the sealing plate 33. The drive circuit 46 is formed on the surface of the silicon single crystal substrate which is the sealing plate 33, by using a semiconductor process (that is, a film formation process, a photolithography process, an etching process, and the like). Further, a wiring layer 47 connected to the drive circuit 46 is formed on the drive circuit 46 of the surface on the piezoelectric element 32 side of the sealing plate 33, in a state of being exposed to the surface on the vibration plate 31 side of the sealing plate 33, in other words, a surface bonded to the vibration plate 31. The wiring layer 47 is routed to a position corresponding to the lower electrode layer 37 and the upper electrode layer 39 that extend to the non-drive region, which is an outer side than the drive circuit 46. In addition, the wiring layer 47 is integrally represented in FIG. 3 for the sake of convenience, and includes a plurality of wirings. Specifically, the wiring layer 47 for the individual electrode (upper electrode layer 39) of the piezoelectric element 32, and the wiring layer 47 for the common electrode (lower electrode layer 37) of each piezoelectric element 32 are patterned on the surface of the sealing plate 33. Each wiring layer 47 is electrically connected to the corresponding wiring terminal in the drive circuit 46.

A drive substrate configured with the pressure chamber substrate 29, on which the vibration plate 31 and the piezoelectric element 32 are stacked, and the sealing plate 33 on which a drive circuit related to the driving of the piezoelectric element 32 is provided are bonded by a bonding resin 43 having the bump electrode 40 interposed therebetween. The bonding resin 43 has a function as a spacer for ensuring an interval between the substrates, a function as sealing material for sealing the accommodating space 45 that accommodates the drive region and the like of the piezoelectric element 32 between the substrates, and a function of an adhesive for bonding the substrates to each other. For example, resins containing a photopolymerization initiator and the like, with epoxy resins, acrylic resins, phenolic resins, polyimide resins, silicone resins, styrene resins or the like as a main component, are preferably used as the bonding resin 43, and in this embodiment, those with the epoxy resins as a main component are employed. In the embodiment, as illustrated in FIG. 4, a first bonding resin **43*a* which is formed in a frame shape in a plan view along the outer edge of the vibration plate 31 and the sealing plate 33, and a second bonding resin 43*b* which is formed in a frame shape surrounding the piezoelectric element group, in the inner side than the formation position of the bump electrode 40 corresponding to the first bonding resins 43*a* and the upper electrode layer 39. The vibration plate 31 and the sealing plate 33 are spaced by the bonding resins 43***a* and 43*b* which are formed double. The gap between the vibration plate 31 and the sealing plate 33 is set so as not to inhibit the strain deformation of the piezoelectric element 32. A third bonding resin 43*c* is formed on the common electrode wiring 45 between the drive region of the piezoelectric element 32 and the common electrode film 36, which is an inner region of the second bonding resin 43*b*. A region surrounded by the second bonding resin 43*b* and the third bonding resin 43*c* is an accommodating space 45 (sealed space) which accommodates the drive region of the piezoelectric element 32.

In the present embodiment, a total of the two accommodating spaces 45 are formed on both sides of the common electrode film 36, between the vibration plate 31 and the sealing plate 33. The drive region of the piezoelectric element 32 corresponding to the nozzle array is housed in each accommodating space 45. In other words, the drive regions of the piezoelectric elements 32 of the number corresponding to the nozzles 22 constituting a nozzle array, are accommodated in the accommodating space 45. The accommodating space 45 occupies a relatively large area between the vibration plate 31 and the sealing plate 33. Therefore, in the electronic device 14 according to the present invention, a reinforced resin 44 (corresponding to a supporting portion in the present invention) that supports the vibration plate 31 and the sealing plate 33 is formed in a position deviated from the drive region of the piezoelectric element 32 in the accommodating space 45. More specifically, as illustrated in FIGS. 4 and 5, a plurality of (three in this embodiment) pillar-shaped reinforced resins 44 are arranged at an interval, between the drive regions of the adjacent piezoelectric elements 32, in other words, at a position corresponding to the partition wall 34 that partitions adjacent pressure chambers 30. The reinforced resin 44 of the present embodiment is composed of photosensitive resin which is the same type of resin as the bonding resin 43, and is formed by the same process as in the bonding resin 43. This will be described later in detail.

The bump electrode 40 is an electrode for connecting the drive circuit 46, the individual electrode (upper electrode layer 39) of each piezoelectric element 32, and the common electrode (lower electrode layer 37), and is arranged so as to come into contact with and be electrically connected to the upper electrode layer 39 and the common electrode film 36 on the non-drive region, respectively. The bump electrode 40 includes an internal resin (resin core) 41 as a protrusion extending along the arrangement direction (nozzle array direction) of the pressure chamber, and a conductive film 42 which is partially formed on the surface of the internal resin 41. The internal resin 41 is made of, for example, a resin having elasticity such as a polyimide resin, and is formed in regions (right and left sides in FIG. 4) facing the non-drive region in which the upper electrode layer 39 of the vibration plate 31 is formed, in the bonding surface of the sealing plate 33, and a region facing the central region in which the common electrode film 36 is formed. Further, the conductive film 42 is a part of the wiring layer 47, and is formed in a position facing the upper electrode layer 39. Therefore, a plurality of conductive films 42 are formed along the nozzle array direction. Similarly, a plurality of conductive films 42 corresponding to the common electrode films 36 are formed along the nozzle array direction.

Next, a process of manufacturing the electronic device 14, in particular, a bonding process of the pressure chamber substrate 29 as a first substrate on which the piezoelectric element 32 and the vibration plate 31 are stacked, and the sealing plate 33 as a second substrate will be described. Further, the electronic device 14 in the present embodiment is obtained by bonding a silicon single crystal substrate including a plurality of regions which are the sealing plate 33 and a silicon single crystal substrate including a plurality of regions which are the pressure chamber substrate 29 on which the vibration plate 31 and the piezoelectric element 32 are stacked, and dicing the bonded substrates into individual pieces.

FIGS. 6 and 7 are schematic views illustrating the manufacturing process of the electronic device 14, and illustrate the configuration of a portion between the drive regions of the piezoelectric element 32, in other words, a portion corresponding to the partition wall 34 partitioning the pressure chambers 30 to each other. First, as illustrated in FIG. 6A, the vibration plate 31 is stacked on the pressure chamber substrate 29, and the lower electrode layer 37 is deposited, by for example, a sputtering method, through an elastic film and an insulating film (not illustrated) thereon. Next, as illustrated in FIG. 6B, the piezoelectric layer 38 made of lead zirconate titanate (PZT) is deposited on the surface of the lower electrode layer 37. In the present embodiment, the piezoelectric layer 38 is formed by using a so-called gel-sol method of converting a so-call sol in which metal organics are dissolved and dispersed in a solvent into gel through coating and drying and firing the gel at a higher temperature. Further, the formation method of the piezoelectric layer 38 is not particularly limited, and for example, it is also possible to use an MOD method, a sputtering method, or the like. Subsequently, as illustrated in FIG. 6C, an upper electrode layer 39 is formed on the upper surface of the piezoelectric layer 38 by a sputtering method, or the like. Next, the upper electrode layer 39 and the piezoelectric layer 38 are patterned by etching. Thus, as illustrated in FIG. 6D, the opening 35 is formed on the piezoelectric layer 38. Thus, the piezoelectric element 32 is formed on the vibration plate 31.

Through the above process, a plurality of regions which are the pressure chamber substrate 29 and the vibration plate 31 are formed on the silicon single crystal substrate. Meanwhile, on the silicon single crystal substrate on the sealing plate 33 side, a drive circuit 46 is first formed on the surface bonded to the vibration plate 31 through a semiconductor process. If the drive circuit 46 is formed, the internal resin 41 of the bump electrode 40 is formed on the bonding surface of the sealing plate 33. Specifically, after a material resin (for example a polyimide resin) is coated at a predetermined thickness, the internal resin 41 having a protrusion is patterned in a predetermined position, through a prebaking process, a photolithography process, and an etching process. If the internal resin 41 is formed, after the wiring layer 47 and metal which is the conductive film 42 of the bump electrode 40 are deposited, the wiring layer 47 and the conductive film 42 are formed through the photolithography process and the etching process. Thus, a plurality of regions which are the sealing plate 33 are formed on the silicon single crystal substrate.

Next, a process proceeds to a bonding process of the silicon single crystal substrate on the drive substrate (the pressure chamber substrate 29 and the vibration plate 31) side and the silicon single crystal substrate on the sealing plate 33 side. Any one bonding surface of the surface (the bonding surface on the sealing plate 33 side) of the vibration plate 31 stacked on the pressure chamber substrate 29 and the surface (the bonding surface on the vibration plate 31 side) of the sealing plate 33 is coated with the photosensitive resin 49 which is the bonding resin 43 and the reinforced resin 44. In the present embodiment, as illustrated in FIG.

6E, the vibration plate 31 of the drive substrate is coated with the photosensitive resin 49 by spin coating, while covering the structures such as the piezoelectric element 32. Here, the photosensitive resin 49 also enters the opening 35 of the piezoelectric layer 38.

Figure 7A:
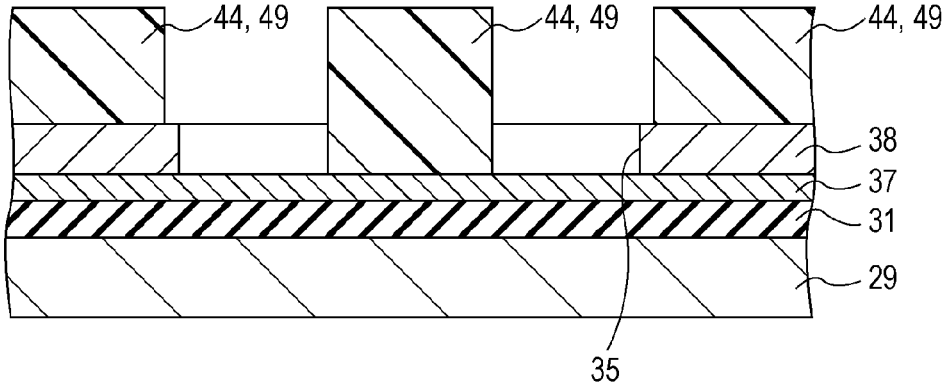
FIG. 7A is a schematic diagram illustrating a manufacturing process of the electronic device.

If the photosensitive resin 49 is applied, subsequently, after being exposed through a mask of a predetermined pattern, the photosensitive resin 49 is provisionally cured through a heating process (provisional curing process). Alternatively, after the photosensitive resin 49 is applied, exposure may also be performed after the heating process. In the provisional curing process, the curing degree of the photosensitive resin 49 is adjusted based on the exposure amount at the time of exposure or the heating amount at the time of heating. Subsequently, as illustrated in FIG. 7A, development is performed, and the photosensitive resin 49 is patterned into a predetermined shape at a predetermined position (patterning process). Thus, reinforced resins 44 are formed and spaced from each other, between the drive regions of the adjacent piezoelectric elements 32, in other words, the portions corresponding to the partition wall 34 partitioning adjacent pressure chambers 30 from each other. In the present embodiment, a total of three reinforced resins 44 are formed along the longitudinal direction of the pressure chamber 30. Further, the photosensitive resin 49 is subjected to patterning, and the bonding resin 43 is formed while surrounding the region in which the drive region of the piezoelectric element 32 is formed.

Figure 7B:
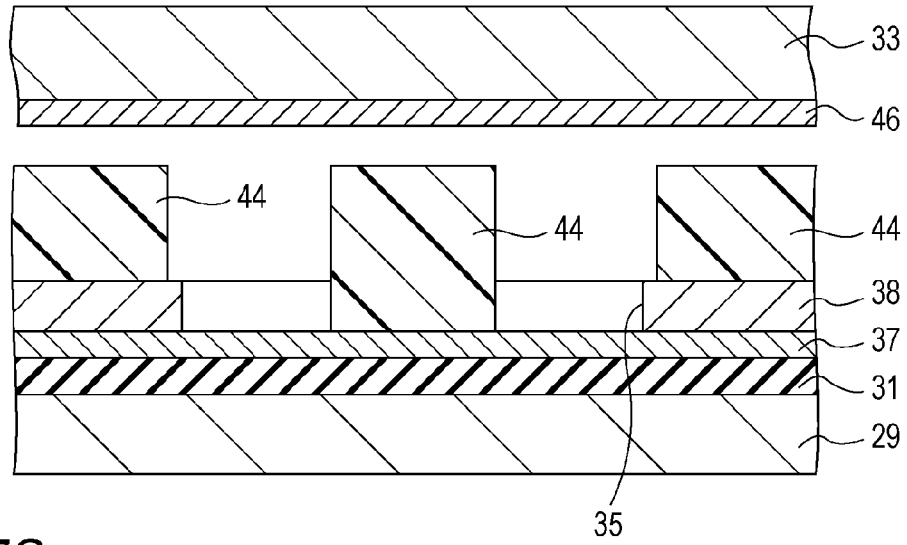
FIG. 7B is a schematic diagram illustrating a manufacturing process of the electronic device.
Figure 7C:
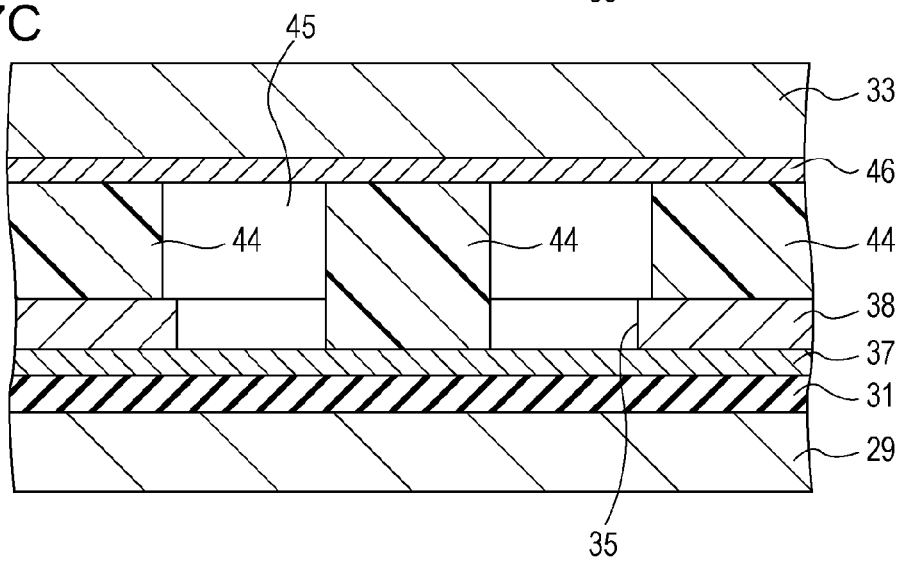
FIG. 7C is a schematic diagram illustrating a manufacturing process of the electronic device.

If the photosensitive resin 49 is patterned into a predetermined shape and the bonding resin 43 and the reinforced resin 44 are formed, both silicon single crystal substrates are bonded (bonding process). Specifically, as illustrated in FIG. 7B, in a state where the relative positions between both silicon single crystal substrates are aligned, any one silicon single crystal substrate is relatively moved towards the other silicon single crystal substrate side, structures such as the bump electrode 40 and the piezoelectric element 32, the bonding resin 43, and the reinforced resin 44 are sandwiched between both silicon single crystal substrates and stacked thereon. Furthermore, in this state, as illustrated in FIG. 7C, both silicon single crystal substrates are pressed in the vertical direction. Here, even if there is undulation due to a structure on the bonding surface of both substrates, the bonding resin 43 and the reinforced resin 44 are elastically deformed, and thus it is possible to bond both substrates such that the bonding surfaces become as parallel as possible. Thus, both substrates are bonded by the bonding resin 43 at a state where the bump electrodes 40 are electrically connected to the lower electrode layer 37 and the upper electrode layer 39 in the non-drive region. At this time, since a plurality of reinforced resins 44 are formed in the accommodating space 45, the reinforced resin 44 supports both substrates, and thus deformation of the substrate such as warpage or distortion of the substrate is suppressed. Thus, a malfunction such as connection failure of the bump electrode 40 to the lower electrode layer 37 and the upper electrode layer 39 is prevented.

If both silicon single crystal substrates are bonded, the pressure chamber 30 is formed by performing a lapping process, a photolithography process, and an etching process on the silicon single crystal substrate on the pressure chamber substrate 29 side. Finally, the silicon single crystal substrate is scribed along a predetermined scribing line, and is cut and divided into individual electronic devices 14. Further, the present embodiment illustrates a configuration in which two sheets of silicon single crystal substrates are bonded and then diced into individual pieces, but the present invention is not limited thereto. For example, the sealing plate and the flow path substrate may be bonded after being respectively diced into individual pieces.

Then, the electronic device 14 which is manufactured by the above process is positioned and fixed in the flow path unit 15 (flow path substrate 28) by using the adhesive or the like. The recording head 3 is manufactured by bonding the head case 16 and the flow path unit 15 at a state in which the electronic device 14 is accommodated in the accommodating hollow portion 17 of the head case 16.

Thus, since the reinforced resin 44 is supported by both substrates even in a configuration in which the accommodating space is formed between the substrates, even if pressure is applied in the stacking direction of the substrates during bonding, deformation of the substrate is suppressed. Thus, it is possible to suppress malfunction due to deformation such as distortion or warpage of the substrate, for example, the contact failure of the electrode according to driving of the drive element. In the present embodiment, the bump electrode 40 is formed on both sides of the region in which the drive region of the piezoelectric element 32 is formed, the accommodating space 45 is formed between these bump electrodes 40, and thus the warpage of the substrate is suppressed by the reinforced resin 44, with the bump electrode 40 as a supporting point at the time of bonding of the substrates, such that contact failure of the bump electrode 40 is prevented.

Moreover, since the reinforced resin 44 related to each of the adjacent drive regions is located in a corresponding position in each accommodating space 45, there is no possibility in that the driving of the piezoelectric element 32 is interfered, by providing the reinforced resin 44. Moreover, since the reinforced resin 44 in this embodiment is made of the resin of the same type of resin as the bonding resin 43, it is possible to form the reinforced resin 44 with the same step as in the bonding resin 43, and an increase in the number of steps can be prevented.

Incidentally, the reinforced resin 44 may not necessarily be the same type of material as the bonding resin 43. For example, it is also possible to employ resin having a higher curing degree than the bonding resin 43 during curing. Thus, since the strength of the reinforced resin 44 is increased, it is possible to more reliably suppress the warpage of the substrate. However, from the viewpoint of absorbing the roughness on the bonding surface of the substrate to some extent, it is desirable to elastically deform the substrates at the time of bonding the substrates to each other.

Figure 8:
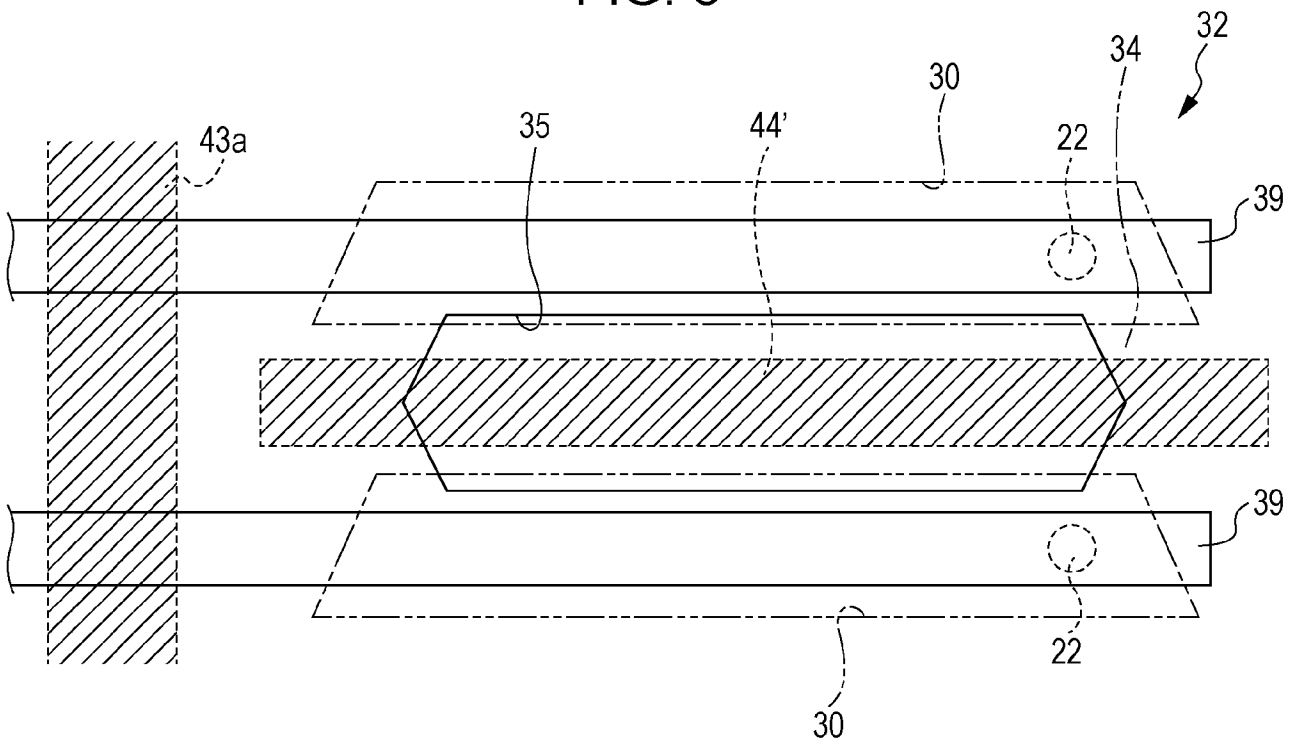
FIG. 8 is an enlarged plan view of an electronic device of a second embodiment.

Furthermore, in the embodiment, a configuration is illustrated in which a plurality of pillar-shaped reinforced resins 44 are arranged at an interval, in a portion corresponding to the partition wall 34 that partitions adjacent pressure chambers 30, but the configuration is not limited thereto. For example, as the second embodiment illustrated in FIG. 8, it is also possible to adopt a configuration of arranging a long rectangular parallelepiped reinforced resin 44' in the direction perpendicular to the arrangement direction of the pressure chamber 30, in a portion corresponding to the partition wall 34 that partitions the adjacent pressure chambers 30. According to this configuration, since the reinforced resin 44' supports a wider area than the substrate, it is possible to more reliably suppress the warpage of the substrate. Further, the formation position of the reinforced resin 44 is not limited to the illustrated position, and may be a position deviated from the drive region in the accommodating space 45.

Further, in the above description, an ink jet recording head mounted on an ink jet printer is exemplified as a liquid ejecting head, but can also be applied to those that eject liquid other than ink. For example, it is possible to apply the present invention to a color material ejecting head used for manufacturing color filters such as a liquid crystal display; an electrode material ejecting head used for electrode formation for an organic electro luminescence (EL) display, a surface emission display (FED), and the like; a bio-organic material ejecting head used for manufacturing biochips (biochemical elements).

Furthermore, the utilization of the present invention is not limited to an electronic device used as an actuator for a liquid ejecting head, and for example, the present invention can also be applied to electronic devices or the like used for various sensors and the like.

What is claimed is:

1. An electronic device comprising:

a first substrate and a second substrate which are bonded through a bonding resin having photosensitivity, the first substrate including a drive element, that deforms a drive region, provided in the drive region for which flexural deformation is acceptable, and the second substrate being provided and spaced from the first substrate by interposing the drive element and a structure related to driving of the drive element therebetween, wherein the bonding resin forms an accommodating space that surrounds and accommodates the drive region, between the first substrate and the second substrate, wherein a supporting portion, that supports the first substrate and the second substrate, is formed at a position deviated from the drive region, in the accommodating space, wherein the drive element comprises a first electrode, a piezoelectric layer disposed on top of the first electrode, and a second electrode disposed on top of the piezoelectric layer, the drive element having an electric field application region that is applied an electric field by the first electrode and the second electrode and a non-electric field application region that is not applied the electric field by the first electrode and the second electrode, and wherein the second electrode extends to the non-electric field application region.

2. The electronic device according to claim 1, wherein the supporting portion related to each of adjacent drive regions is arranged in a corresponding position, in the accommodating space thereof.

3. The electronic device according to claim 1, wherein the supporting portion is formed by a resin of the same type as the bonding resin.

4. The electronic device according to claim 1, wherein a bump electrode related to driving of the drive element is formed on any one substrate of the first substrate and the second substrate so as to protrude in the other substrate, wherein the bump electrodes are respectively arranged on both sides in a direction perpendicular to an arrangement direction of the drive region, across a region in which the drive region is formed, and wherein the accommodating space is formed between the bump electrodes on both sides.

5. A manufacturing method of an electronic device, the electronic device including a first substrate and a second substrate which are bonded through a bonding resin having photosensitivity, the first substrate including a drive element, that deforms a drive region, provided in the drive region for which flexural deformation is acceptable, and the second substrate being provided and spaced from the first substrate by interposing the drive element and a structure related to driving of the drive element therebetween, the manufacturing method comprising:

applying a resin having photosensitivity to the first substrate;

forming a bonding resin that forms an accommodating space which accommodates the drive region, by patterning the applied resin and surrounding a region in which the drive region is formed, and a supporting portion that supports the first substrate and the second substrate at a position deviated from the drive region, in the accommodating space; and bonding the first substrate and the second substrate, in a state of interposing the bonding resin and the supporting portion between the first substrate and the second substrate.

6. The electric device according to claim 1, wherein the structure related to driving of the drive element has a bump electrode, wherein the bump electrode contacts with the second electrode in the non-electric field application region.

7. An electronic device comprising:

a first substrate and a second substrate which are bonded through a bonding resin having photosensitivity, the first substrate including a drive element, that deforms a drive region, provided in the drive region for which flexural deformation is acceptable, and the second substrate being provided and spaced from the first substrate by interposing the drive element and a structure related to driving of the drive element therebetween, wherein the bonding resin forms an accommodating space that surrounds and accommodates the drive region, between the first substrate and the second substrate, wherein a supporting portion, that supports the first substrate and the second substrate, is formed at a position deviated from the drive region, in the accommodating space, wherein the drive element comprises a first electrode, a piezoelectric layer disposed on top of the first electrode, and a second electrode disposed on top of the piezoelectric layer, wherein the structure related to driving of the drive element has a bump electrode that includes an internal resin that is made of a resin having elasticity, and a conductive film which is partially formed on the surface of the internal resin, and wherein the bump electrode contacts with the second electrode.

* * * * *